US005681006A

United States Patent [19]

Herd et al.

[11] Patent Number: 5,681,006

[45] Date of Patent: Oct. 28, 1997

[54] APPARATUS FOR WINDING AN ELECTRICAL CONDUCTOR ON A COIL FORM

[75] Inventors: Kenneth Gordon Herd, Niskayuna; Evangelos Trifon Laskaris, Schenectady; Richard Andrew Ranze, Scotia, all of N.Y.

[73] Assignee: General Electric Company, Schenectady, N.Y.

[21] Appl. No.: 589,438

[22] Filed: Jan. 22, 1996

[51] Int. Cl.[6] ..... H01F 7/22

[52] U.S. Cl. ..... 242/447.1; 242/25 R; 29/605

[58] Field of Search ..... 242/447.1, 447.2, 242/25 R; 29/605

[56] References Cited

U.S. PATENT DOCUMENTS

| | | | |
|---|---|---|---|
| 807,133 | 12/1905 | Scott | 242/447.1 |
| 1,817,884 | 8/1931 | Vienneau | 242/447.1 |
| 2,401,676 | 6/1946 | Weber | 242/447.1 |
| 3,109,601 | 11/1963 | Van Der Hoek et al. | 242/447.2 |
| 4,202,512 | 5/1980 | Nicholson, Jr. | 242/25 R |
| 4,484,712 | 11/1984 | Leenders | 242/447.1 |
| 4,500,860 | 2/1985 | Vermilyea . | |
| 4,561,175 | 12/1985 | Kawasumi | 242/447.1 |
| 4,808,959 | 2/1989 | Weissman | 242/447.1 |
| 4,967,464 | 11/1990 | Stephens . | |
| 5,174,013 | 12/1992 | Hiroshima et al. | 242/25 R |

*Primary Examiner*—Katherine Matecki

*Attorney, Agent, or Firm*—Douglas E. Erickson; Marvin Snyder

[57] ABSTRACT

Apparatus for winding an electrical conductor, having a compressible electrical insulation, on a coil form to make a conductive coil. A rotating device rotates the coil form. A guiding device guides the conductor, near the coil form, longitudinally toward the second end of the coil form so that successive turns of the conductor are generally abutting and are laid down in a first layer. A locating and longitudinally-translating device moves a rotatable wheel so that its rim contacts, and is rotated by, the rotating coil form and so that a side of the wheel applies a first longitudinally-compressive force to a portion of a presently-wound turn of the first layer of the conductor in a direction toward the first end of the coil form.

5 Claims, 5 Drawing Sheets

APPARATUS FOR WINDING AN ELECTRICAL CONDUCTOR ON A COIL FORM

BACKGROUND OF THE INVENTION

The present invention relates generally to an apparatus for making a conductive coil, and more particularly to an apparatus for winding an electrical conductor on a coil form.

Conductive coils include those having an electrical conductor wound in turns and layers around a coil form. Examples of conductive coils include, without limitation, a rotor of an electric motor, wherein the rotor includes an insulated resistive conductor (such as a copper wire surrounded by a plastic electrical insulation) wound around an iron core, and a magnetic coil of a magnetic resonance imaging (MRI) system, wherein the magnetic coil includes an insulated superconductor (such as a Niobium-Titanium wire surrounded by compressible electrical insulation in the form of spiral-wound aromatic-polyamide electrical insulation tape having non-contacting spiral turns) wound around a fiberglass cylindrical coil form.

Conventional machines exist for winding an electrical conductor on a coil form to make a conductive coil, wherein the first end of the conductor has been secured to the coil form near the coil form's first end, and wherein the conductor then has been placed under tension. Devices simultaneously rotate the coil form (up to ten revolutions-per-minute) and guide the conductor longitudinally toward the coil form's second end so that successive turns of the conductor are generally abutting and are laid down in a first layer which surrounds the coil form. In the case of a superconductor having a compressible electrical insulation, the coil form's rotation would be stopped as one or more turns of the first layer of the superconductor are longitudinally-compressed in a direction toward the coil form's first end by a hammer blow applied to a wedge or applied directly to the conductor. Such longitudinal compression helps the superconductive coil maintain its geometry (and hence the uniformity of its magnetic field) under the magnetic forces generated during MRI operation. Unfortunately, such hammer blows can damage the superconductor and the coil form. Also, stopping the rotation of the coil form for the hammer blows increases manufacturing time and costs.

What is needed is an improved apparatus for making a conductive coil.

SUMMARY OF THE INVENTION

The apparatus of the invention is for winding an electrical conductor on a coil form to make a conductive coil having turns and layers of the conductor, wherein the coil form has first and second ends and a generally-longitudinally-extending first axis of rotation, and wherein the conductor has a compressible electrical insulation and has a first end secured to the coil form near the first end of the coil form. The apparatus includes a device for rotating the coil form in a first direction about the axis of rotation. The apparatus also includes a device for guiding the conductor, near the coil form, longitudinally toward the coil form's second end so that successive turns of the conductor are generally abutting and are laid down in a first layer which surrounds the coil form. The apparatus further includes a rotatable wheel having first and second opposing sides, a generally-longitudinally-extending second axis of rotation passing generally perpendicularly through the sides, and a radially-outwardly-facing rim attached to the sides. The apparatus additionally includes a device for disposing and longitudinally translating the wheel so that the second axis of rotation is generally parallel with the first axis or rotation, the rim contacts and is rotated by the rotating coil form, and the first side of the wheel applies a first longitudinally-compressive force to a first portion of a presently-wound turn of the first layer of the conductor in a direction toward the first end of the coil form.

In a preferred apparatus of the invention, the first longitudinally-compressive force is applied to the conductor at a point of tangency where the conductor first makes contact with the coil form.

Several benefits and advantages are derived from the method of the invention. The longitudinally-compressive force is uniformly applied to the conductor as the turns of the conductor are being laid down in a layer, thus avoiding damage to the conductor and the coil form from the prior art hammer blows and thus minimizing manufacturing time and costs by avoiding having to stop rotation of the coil form for the prior art hammer blows. Also, in a superconductive MRI system, a more uniformly-compressed conductor will maintain its geometry when the superconductive coil is subjected to magnetic forces during MRI operation which yields a more uniform magnetic field resulting in sharper MRI images. It is noted that a smaller longitudinally-compressive force is needed to compress the conductor when such force is applied at the point of tangency (as in the preferred apparatus of the invention), where the conductor first makes contact with the coil form, compared to the force needed to also overcome friction to compress a conductor (which typically is being wound under tension) already laid down on top of the coil form or an underlying layer of conductor.

BRIEF DESCRIPTION OF THE DRAWINGS

The accompanying drawings illustrate a method and an apparatus (i.e., a machine) for winding an electrical conductor on a coil form to make a conductive coil, wherein.

DETAILED DESCRIPTION OF THE INVENTION

Figure 1:
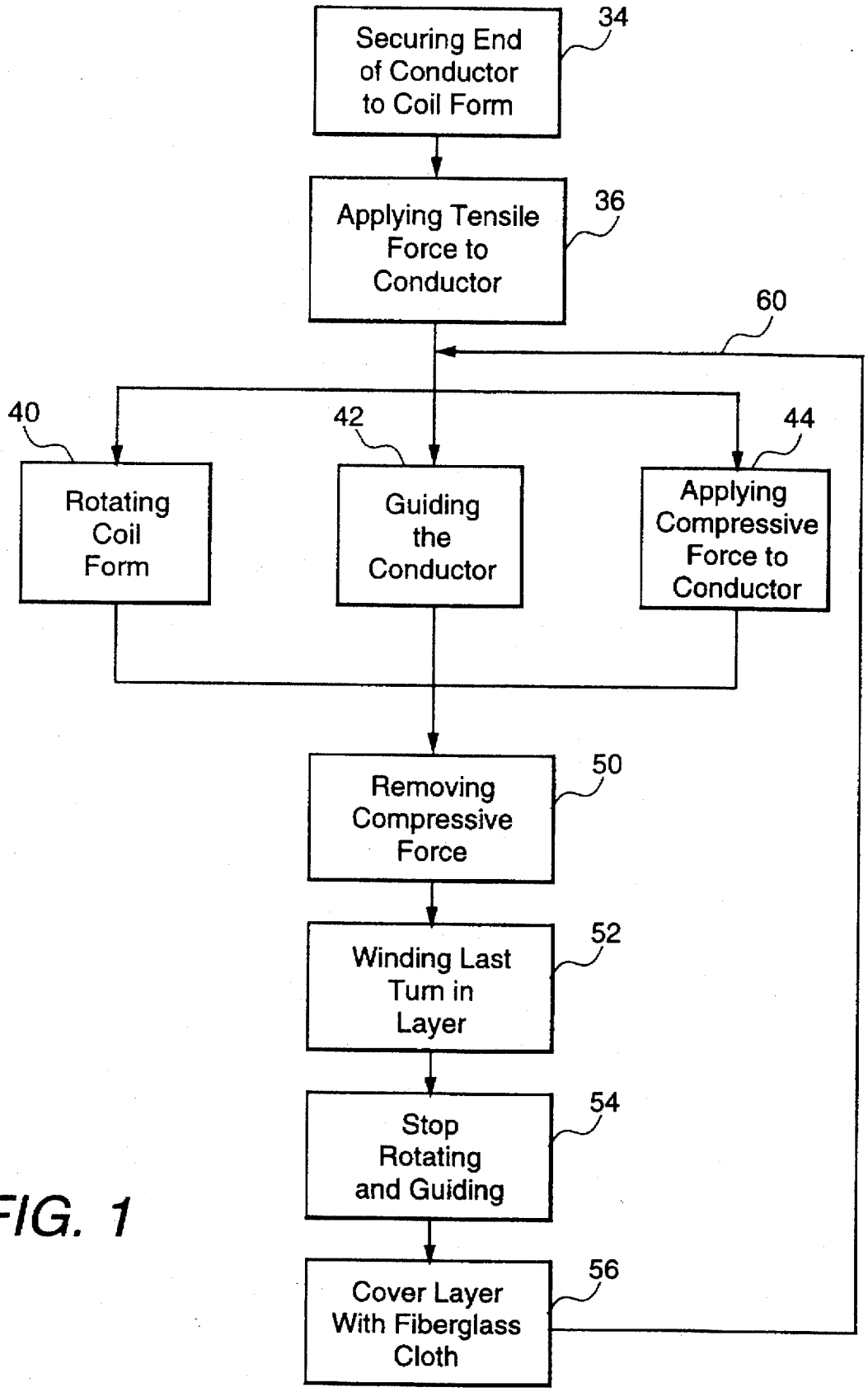
FIG. 1 is a schematic flow diagram of a first preferred method for winding an electrical conductor on a coil form.
Figure 2:
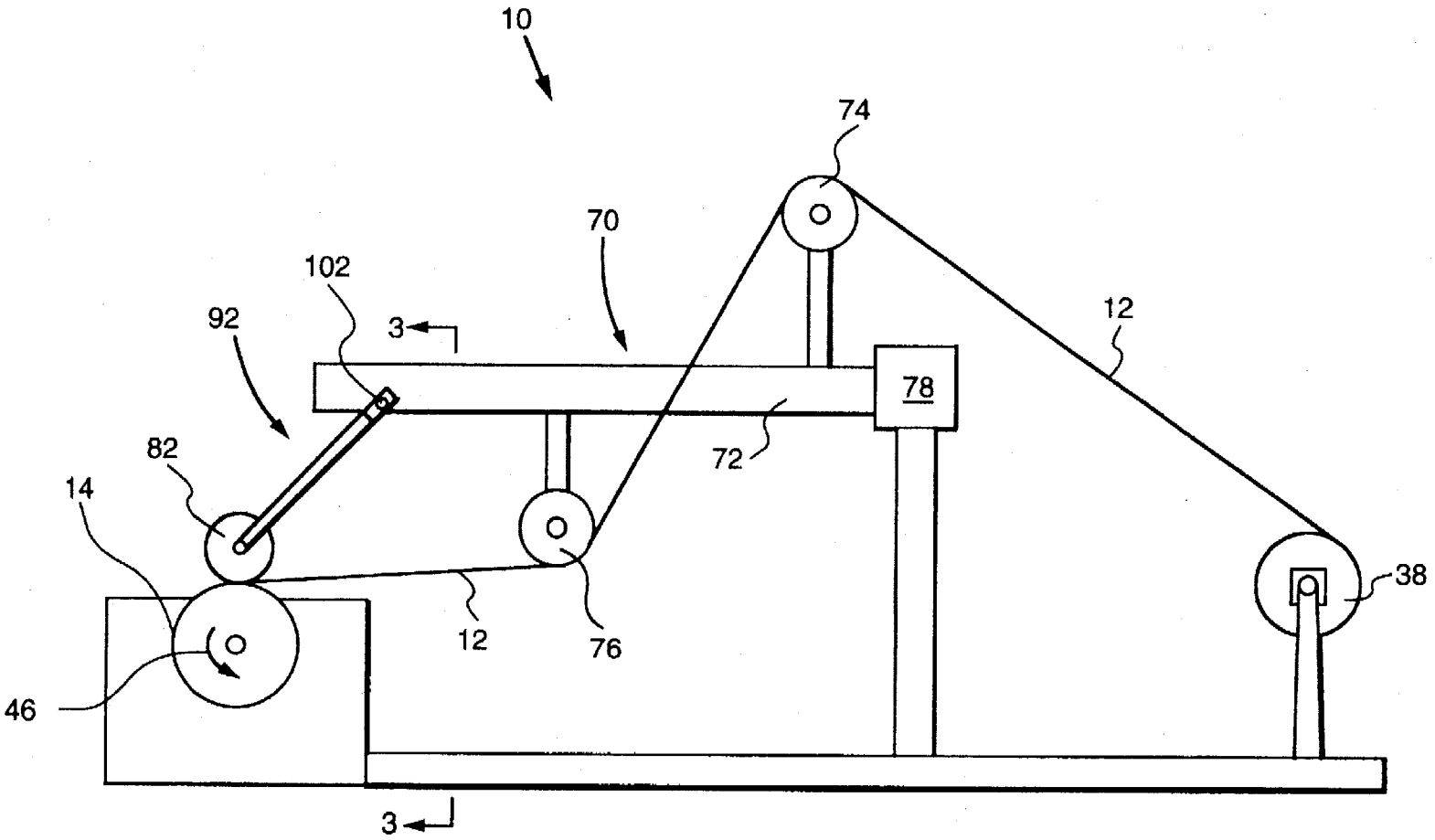
FIG. 2 is a schematic side-elevational view of a first preferred apparatus of the invention for carrying out the first preferred winding method of FIG. 1.
Figure 3:
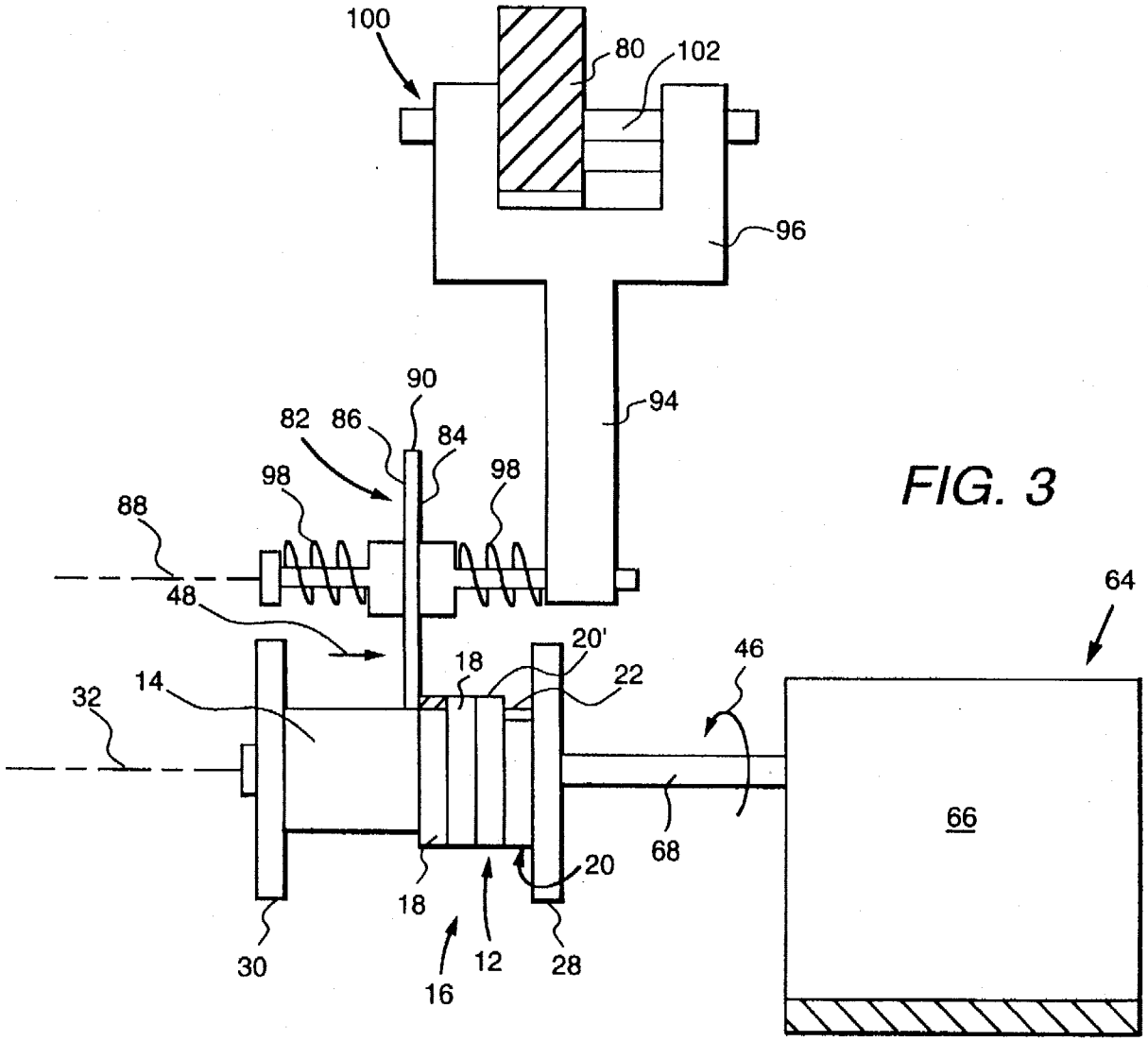
FIG. 3 is a schematic cross-sectional view taken along arrows 3—3 in FIG. 2 showing the winding of a first layer of the conductor on the coil form.
Figure 4:
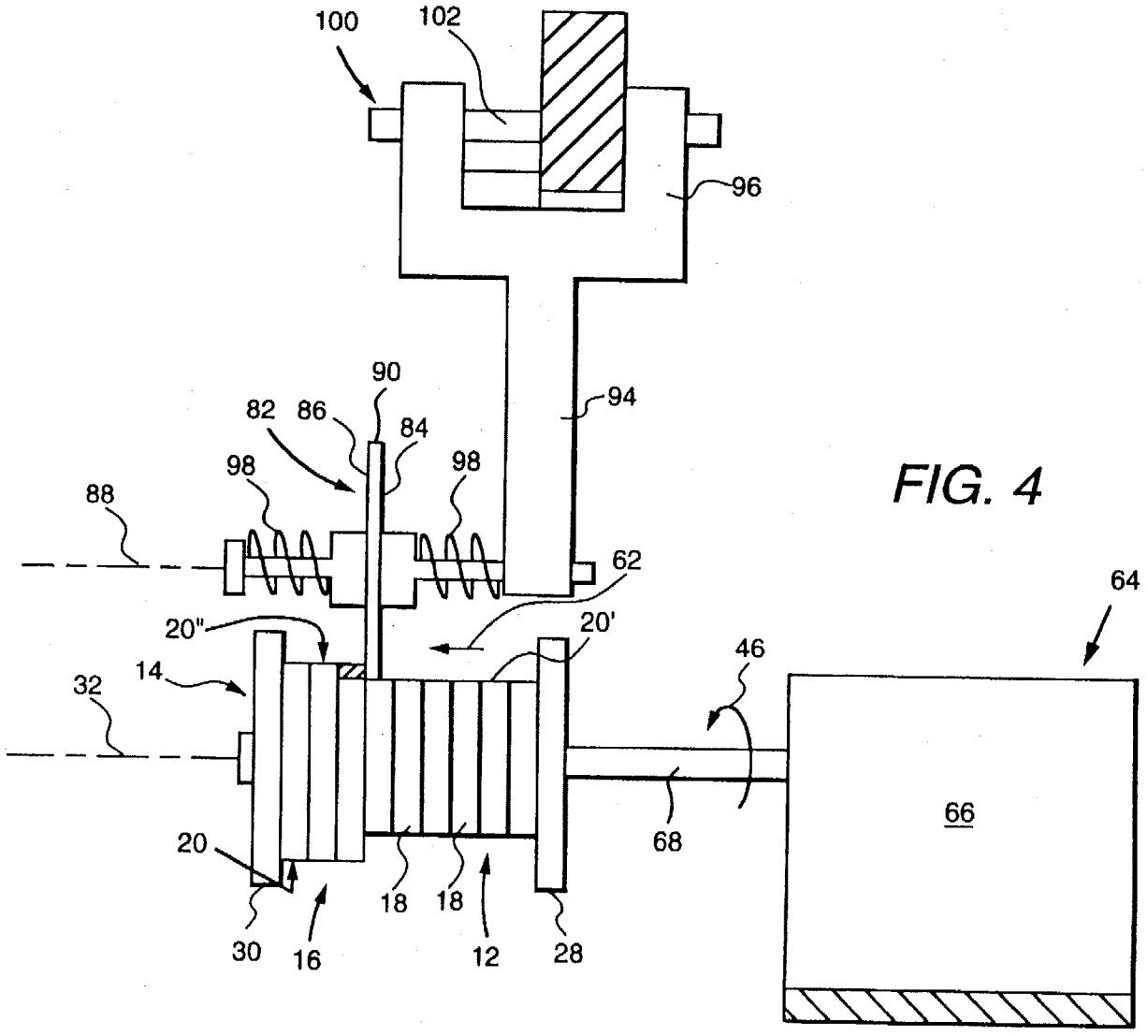
FIG. 4 is a view, as in FIG. 3, but showing the winding of a second layer of the conductor over the first layer of the conductor.
Figure 5:
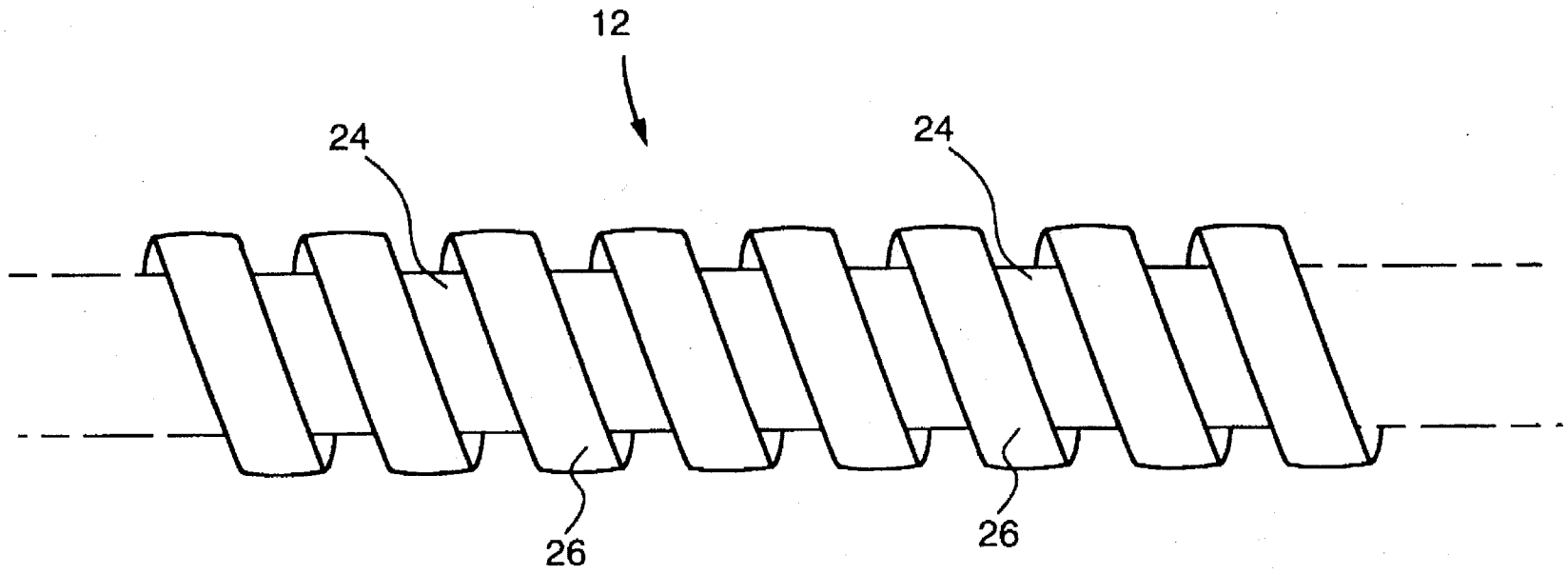
FIG. 5 is an enlarged schematic side-elevational view of an unwound portion of the conductor.

Referring now to the drawings, wherein like numerals represent like elements throughout, FIG. 1 outlines, in generalized block diagram form, a first preferred method, and FIGS. 2 through 4 show a first preferred embodiment of an apparatus (i.e., a machine) 10 of the invention for carrying out the first preferred method outlined in FIG. 1. The method is for winding an electrical conductor 12 on a coil form 14 to make a conductive coil 16 having turns 18 and layers 20 of the conductor 12. The conductor 12 has a first end 22 and, as shown in FIG. 5, includes a conductive central region 24 and a compressible electrical insulation 26 which at least partially covers the conductive central region 24. Preferably, the compressible electrical insulation 26 is a spiral-wound electrical insulation having non-contacting spiral turns, the conductor 12 is a superconductor, the conductive central region 24 includes a niobium-titanium wire, and the compressible electrical insulation 26 includes an aromatic-polyamide tape. The coil form 14 has first and second ends 28 and 30 and a generally-longitudinally-extending first axis of rotation 32.

The first preferred method includes several steps and begins with a step portrayed in block 34 of FIG. 1 as "Securing End Of Conductor To Coil Form". This step includes securing the first end 22 of the conductor 12 to the coil form 14 proximate the first end 28 of the coil form 14. Preferably, such securing is accomplished by soldering the first end 22 of the conductor 12 to a copper piece (not shown) which has been attached to the (preferably fiberglass) coil form 14 by using epoxy.

A desirable next step, after performing the securing step portrayed in block 34, is portrayed in block 36 as "Applying Tensile Force To Conductor". As block 36 states, this step includes applying a tensile force to the conductor 12. Preferably, the tensile force is between generally ten and generally sixty pounds and is accomplished by having a brake (i.e., a drag) on the spool 38 which supplies the conductor 12.

After the step portrayed in block 34 (and, if present, the step portrayed in block 36) is performed, three additional steps, portrayed in blocks 40, 42, and 44, are simultaneously performed. One of the three simultaneously-performed steps is portrayed in block 40 as "Rotating Coil Form". This step includes rotating the coil form 14 in a first direction 46 (indicated by a curved arrow) about the first axis of rotation 32. It is noted that the coil form 14 is rotated only in the first direction 46 throughout the entire winding of the turns 18 and layers 20 of the conductive coil 16. Typical rotational speeds range up to generally ten revolutions-per-minute. Another of the three simultaneously-performed steps is portrayed in block 42 as "Guiding The Conductor". This step, for the first layer 20', includes guiding the conductor 12, proximate the coil form 14, longitudinally toward the second end 30 of the coil form 14 so that successive turns 18 of the conductor 12 are generally abutting and are laid down in a first layer 20' which surrounds the coil form 14. It is noted that this step, for each successive odd-number layer 20, includes guiding the conductor 12, proximate the coil form 14, longitudinally toward the second end 30 of the coil form 14 so that successive turns 18 of the conductor 12 are generally abutting and are laid down in a layer 20 which surrounds the underlying even-numbered layer 20. A further one of the three simultaneously-performed steps is portrayed in block 44 as "Applying Compressive Force To Conductor". This step includes applying a first continuously-longitudinally-compressive force to the conductor 12 in a direction (indicated by arrow 48) toward the first end 28 of the coil form 14 as at least two successive turns 18 of the conductor 12 are being laid down in the first layer 20' (or in a later odd-numbered layer 20).

In an exemplary method, the first longitudinally-compressive-force is applied to the conductor 12 at a point of tangency where the conductor 12 first makes contact with the coil form 14 (or with the underlying layer 20). This allows a smaller force to be used, one that generally just has to compress the conductor. A larger force would be needed, one that would also have to overcome friction, if such force were applied to an already laid-down portion of a turn 18 of the conductor 12.

Other steps in the first preferred method are portrayed in blocks 50, 52, 54, and 56. The step in block 50 is portrayed as "Removing Compressive Force". This step includes removing the first continuously-longitudinally-compressive force just before winding a last turn 18 of the first layer 20' (or any other odd-numbered layer 20) of the conductor 12 proximate the second end 30 of the coil form 14. The step in block 52 is portrayed as "Winding Last Turn In Layer". This step includes continuing to rotate the coil form 14 and continuing to guide the conductor 12 to wind the last turn 18 of the first layer 20' (or any other layer 20). The step in block 54 is portrayed as "Stop Rotating And Guiding". This step includes stopping rotation of the coil form 14 and stopping guidance of the conductor 12 after the first layer 20' (or any other layer 20) has been completely laid down. The step in block 56 is portrayed as "Cover Layer With Fiberglass Cloth". This desirable step includes, after winding the first layer 20' (or any other layer 20), covering the first layer 20' (or other layer 20) with a fiberglass cloth for extra electrical insulation between layers 20 of the conductor 12.

The block-diagram flow-line 60 which leads from block 56 to just below block 36 indicates that, after winding the first layer 20' of the conductor 12, the first preferred method continues by repeating the three simultaneously performed steps, but as applied to the winding of the second layer 20". Here, the step in block 40 is the same in winding the second layer 20" as it was in winding the first layer 20', namely rotating the coil form 14 in the first direction 46 about the first axis of rotation 32. Here, the step in block 42 includes guiding the conductor 12, proximate the coil form 14, longitudinally toward the first end 28 of the coil form 14 so that consecutive turns 18 of the conductor 12 are generally abutting and are laid down in a second layer 20" which surrounds the first layer 20'. Here, the step in block 44 includes applying a second continuously-longitudinally-compressive force to the conductor 12 in a direction (indicated by arrow 62) toward the second end 30 of the coil form 14 as at least two successive turns 18 of the conductor 12 are being laid down in the second layer 20". In an exemplary method, the second longitudinally-compressive-force is applied to the conductor 12 at a point of tangency where the conductor 12 first makes contact with the underlying layer 20. Here, the step in block 50 includes removing the second continuously-longitudinally-compressive force just before winding a last turn 18 of the second layer 20" (or any other even-numbered layer 20) of the conductor 12 proximate the first end 28 of the coil form 14.

Preferably, the second continuously-longitudinally-compressive force is equal to generally the first continuously-longitudinally-compressive force, and the first continuously-longitudinally-compressive force is a generally constant force of between generally one and generally ten pounds. It is noted that successive odd-numbered layers 20 are laid down generally in the manner indicated for laying down the first layer 20'. Likewise, it is noted that successive even-numbered layers 20 are laid down generally in the manner indicated for laying down the second layer 20".

The first preferred embodiment of the apparatus 10 of the invention is for winding the electrical conductor 12 on the coil form 14 to make the conductive coil 16 having turns 18 and layers 20 of the conductor 12, wherein the coil form 14 has its first and second ends 28 and 30 and its generally-longitudinally-extending first axis of rotation 32, and wherein the conductor 12 has its compressible electrical insulation 26 and has its first end 22 secured to the coil form 14 proximate the first end 28 of the coil form 14. The apparatus 10 includes means 64 for rotating the coil form 14 in the first direction 46 about the first axis of rotation 32. Preferably, such rotating means 64 includes a housed, variable-speed electric motor 66 whose horizontally-disposed rotatable shaft 68 is attachable to the coil form 14. Other such rotating means 64 include variously-powered rotating turntables, as is well known in the art.

The apparatus 10 also includes means 70 for guiding the conductor 12, proximate the coil form 14, longitudinally toward the second end 30 of the coil form 14 so that successive turns 18 of the conductor 12 are generally abutting and are laid down in the first layer 20' which surrounds the coil form 14. In an exemplary embodiment, such guiding means 70 also includes means for directing the conductor 12, proximate the coil form 14, longitudinally toward the first end 28 of the coil form 14, after winding the first layer 20' of the conductor 12, so that successive turns of the conductor 12 are generally abutting and are laid down in the second layer 20" which surrounds the first layer 20'. It is noted that any intervening fiberglass cloth (not shown) may be manually placed over the first layer 20' before winding the second layer 20". Preferably, such guiding means 70, including such directing means, includes a longitudinally-movable beam 72, two rotatable disks 74 and 76 rotatably attached to the beam 72, and a controller 78 which longitudinally moves the beam 72 (into and out from the paper, as seen in FIG. 2), in either direction, between the two ends 28 and 30 of the coil form 14 at a speed reflecting the coil form 14 rotational speed, the conductor 12 thickness, and the diameter of the turn 18 so that the conductor 12, when placed on the disks 74 and 76 between the spool 38 and the coil form 14, is laid down in generally abutting turns 18 in a longitudinally-extending layer 20, as can be appreciated by the artisan. It is noted that the beam 72 has a section 80 with a thickness. Other such means 70 include longitudinally-translating arms, and the like, as is well known in the art.

The apparatus 10 additionally includes a rotatable wheel 82. The wheel 82 has a thickness, first and second opposing sides 84 and 86, a generally-longitudinally-extending second axis of rotation 88 passing generally perpendicularly through the sides 84 and 86, and a radially-outwardly-facing rim 90 attached to the sides 84 and 86. Preferably, the wheel consists essentially of stainless steel.

The apparatus 10 further includes means 92 for disposing and longitudinally translating the wheel 82 so that the second axis of rotation 88 is generally parallel with the first axis of rotation 32, the rim 90 contacts and is rotated by the rotating coil form 14, and the first side 84 of the wheel 82 applies the first longitudinally-compressive force to a first portion of a presently-wound turn of the first layer 20' of the conductor 12 in the direction 48 toward the first end 28 of the coil form 14. In an exemplary embodiment, the disposing and longitudinally-translating means 92 includes means for positioning and axially translating the wheel 82, after winding the first layer 20' of the conductor 12, so that the rim 90 contacts the first layer 20' of the conductor 12 and so that the second side 86 of the wheel 82 applies the second longitudinally-compressive force to a second portion of a currently-wound turn 18 of the second layer 20" of the conductor 12 in the direction 62 toward the second end 30 of the coil form 14. Preferably, such disposing and longitudinally-translating means 92, including such positioning and axially-translating means, includes the longitudinally-movable beam 72 and the controller 78 in common with the guiding means 70 and further includes an arm 94. The arm 94 has first and second ends, wherein the wheel 82 is rotatably attached to the first end of the arm 94, and wherein the second end of the arm 94 includes a yoke 96 which is attached to the section 80 of the beam 72 and which has an opening wider than the sum of the thickness of the beam section 80 and the thickness of the wheel 82. Other such means 92 include longitudinally-translating arms, and the like, as is well known in the art. It is preferred that the disposing and longitudinally-translating means 92 is positioned and aligned such that it disposes and longitudinally translates the wheel 82 so that the first side 84 of the wheel 82 applies the first longitudinally-compressive force at a point of tangency where the conductor 12 of the presently-wound turn 18 of the first layer 20' first makes contact with the coil form 14.

Preferably, the wheel 82 is spring-loaded in both directions along the second axis of rotation 88 by two springs 98. In a preferred construction, the turns 18 of the conductor 12 each have a generally identical thickness along the first axis of rotation 32, and the thickness of the wheel 82 is smaller than the thickness of each of the turns 18 of the conductor 12. In an exemplary construction, the disposing and longitudinally-translating means 92 includes means 100 for removing the wheel 82 from the conductor 12 and the coil form 14 just before winding a last turn of the first layer 20' of the conductor 12 proximate the second end 30 of the coil form 14. Preferably, such removing means 100 includes a pivot pin 102 which passes through the yoke 96 and the section 80 of the beam 72 to allow the arm 94 to be manually pivoted away from the coil form 14. Other such means 100 include the arm 94 having telescoping sections, and the like, as can be appreciated by the artisan.

It is pointed out that a weight (not shown) may be added to the arm 94 near its first end (i.e., the end having the wheel 82). Also, a shim block 104 may be positioned next to the beam section 80 so that the opening of the yoke 96 is entirely longitudinally filled. The shim block 104 would be positioned to the right of the beam section 80 (see FIG. 3) when winding odd-numbered layers 20 and would be positioned to the left of the beam section 80 (see FIG. 4) when winding even-numbered layers 20, as can be appreciated by those skilled in the art.

It is noted, that the method of FIG. 1 can be practiced without the wheel 82 of the first preferred embodiment of the apparatus 10 of the invention. For example, and without limitation, the first end of the arm 94 can include a spring-loaded finger (not shown) which directly applies the first and second longitudinally-compressive forces.

The foregoing description of several preferred embodiments of the apparatus of the invention has been presented for purposes of illustration. It is not intended to be exhaustive or to limit the invention to the precise form disclosed, and obviously many modifications and variations are possible in light of the above teaching. It is intended that the scope of the invention be defined by the claims appended hereto.

We claim:

1. Apparatus for winding an electrical conductor on a coil form to make a conductive coil having turns and layers of said conductor, wherein said coil form has first and second ends and a generally-longitudinally-extending first axis of rotation, wherein said conductor has a compressible electrical insulation and has a first end secured to said coil form proximate said first end of said coil form, and wherein said apparatus comprises:

a) means for rotating said coil form in a first direction about said first axis of rotation;

b) means for guiding said conductor, proximate said coil form, longitudinally toward said second end of said coil form so that successive turns of said conductor are generally abutting and are laid down in a first layer which surrounds said coil form;

c) a rotatable wheel having first and second opposing sides, having a generally-longitudinally-extending second axis of rotation passing generally perpendicularly through said sides, and having a radially-outwardly-facing rim attached to said sides; and d) means for disposing and longitudinally translating said wheel so that said second axis of rotation is generally parallel with said first axis of rotation, said rim contacts and is rotated by said rotating coil form, and said first side of said wheel applies a first longitudinally-compressive force to a first portion of a presently-wound turn of said first layer of said conductor in a direction toward said first end of said coil form, wherein said disposing and longitudinally-translating means includes means for removing said wheel from said conductor and said coil form just before winding a last turn of said first layer of said conductor proximate said second end of said coil form, wherein said guiding means includes means for directing said conductor, proximate said coil form, longitudinally toward said first end of said coil form, after winding said first layer of said conductor, so that successive turns of said conductor are generally abutting and are laid down in second layer which surrounds said first layer, wherein said disposing and longitudinally-translating means includes means for positioning and axially translating said wheel, after winding said first layer of said conductor, so that said rim contacts said first layer of said conductor and so that said second side of said wheel applies a second longitudinally-compressive force to a second portion of a currently-wound turn of said second layer of said conductor in a direction toward said second end of said coil form, wherein said wheel is spring-loaded in both directions along said second axis of rotation, and wherein said wheel has a thickness, and wherein said guiding means and said disposing and longitudinally-translating means have in common a longitudinally-movable beam including a section with a thickness.

2. The apparatus of claim 1, wherein said disposing and longitudinally-translating means includes an arm having two ends, wherein said wheel is rotatably attached to said first end of said arm, and wherein said second end of said arm includes a yoke which is attached to said section of said beam and which has an opening wider than the sum of said thickness of said section of said beam and said thickness of said wheel.

3. The apparatus of claim 2, wherein said disposing and longitudinally-translating means disposes and longitudinally translates said wheel so that said first side of said wheel applies said first longitudinally-compressive force at a point of tangency where said conductor of said presently-wound turn of said first layer first makes contact with said coil form.

4. The apparatus of claim 3, wherein said turns of said conductor each have a generally identical thickness along said first axis of rotation, and wherein said thickness of said wheel is smaller than said thickness of each of said turns of said conductor.

5. The apparatus of claim 4, wherein said conductor is a superconductor, and wherein said electrical insulation is a spiral-wound electrical insulation having non-contacting spiral turns.

* * * * *